US007275889B1

(12) United States Patent
McGill

(10) Patent No.: US 7,275,889 B1
(45) Date of Patent: Oct. 2, 2007

(54) TARGETED TETHERED TIRE CAPTURE PROJECTILE

(76) Inventor: David T. McGill, 43460 Via Barrozo, Temecula, CA (US) 92592

( * ) Notice: Subject to any disclaimer, the term of this patent is extended or adjusted under 35 U.S.C. 154(b) by 172 days.

(21) Appl. No.: 11/449,929

(22) Filed: Jun. 9, 2006

(51) Int. Cl.
*E01F 13/00* (2006.01)

(52) U.S. Cl. ..... 404/6

(58) Field of Classification Search ..... 404/6; 180/287; 280/762
See application file for complete search history.

(56) References Cited

U.S. PATENT DOCUMENTS

| | | | | |
|---|---|---|---|---|
| 5,067,237 | A | 11/1991 | Holder | |
| 5,480,108 | A | 1/1996 | Amiand et al. | |
| 5,611,408 | A | 3/1997 | Abukhader | |
| 5,839,759 | A * | 11/1998 | Trigo | 280/762 |
| 5,839,849 | A | 11/1998 | Pacholok et al. | |
| 5,921,704 | A | 7/1999 | Pacholok et al. | |
| 6,135,226 | A * | 10/2000 | Persichini et al. | 180/167 |
| 6,176,519 | B1 | 1/2001 | Limingoja | |
| 6,246,323 | B1 | 6/2001 | Fischbach | |
| 6,527,475 | B1 | 3/2003 | Lowrie | |
| 6,623,205 | B1 | 9/2003 | Ramirez | |
| 6,650,283 | B2 | 11/2003 | Brydges et al. | |
| 6,715,395 | B1 | 4/2004 | Heibel | |
| 6,758,628 | B1 * | 7/2004 | Curry, Jr. | 404/6 |
| 6,869,248 | B1 * | 3/2005 | Threlkeld | 404/6 |
| 2005/0038592 | A1 | 2/2005 | DeSylva | |

FOREIGN PATENT DOCUMENTS

| | | | |
|---|---|---|---|
| GB | 2 409 229 | * | 6/2005 |

* cited by examiner

*Primary Examiner*—Gary S. Hartmann
(74) *Attorney, Agent, or Firm*—Gene Scott, Patent Law & Venture Group

(57) ABSTRACT

A pursuit vehicle carries a projectile housed within a launcher mounted on its front end. The projectile is able to be directed at high speed from the launcher toward a tire of a pursued vehicle. A tether line is coiled about a tether reel within the chase vehicle and is fixed to the projectile. The projectile has folded barbs that extend once the projectile has entered the tire and which keeps the projectile from flying out of the tire due to centripetal force. Being penetrated, the tire quickly looses pressure and deflates while the tether line wraps itself around the wheel's axle and brakes which can cause the wheel to stop spinning.

5 Claims, 2 Drawing Sheets

TARGETED TETHERED TIRE CAPTURE PROJECTILE

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to devices for disabling a pursued vehicle including devices that are placed under the vehicle while in motion, and more particularly to a device that is projected through the air to penetrate a tire of the fleeing vehicle.

2. Description of Related Art Including Information Disclosed Under 37 CFR 1.97 and 1.98

In dealing with vehicles that are fleeing from law enforcement a number of solutions have been invented. Typical among them are tire deflating devices which are used in an attempt to disable a fleeing vehicle while, at the same time, maintaining safety for the law officers, the general public and the individuals that are being pursued. Numerous devices have been invented to deflate the tires of a motor vehicle by placing upwardly-extending metal spikes in the path of the vehicle. Such devices can be used by law enforcement officers to stop or slow target vehicles. One such device is disclosed in Kilgrow et al, U.S. Pat. No. 5,253,950. This device comprises a tire deflator which can be extended from a collapsed condition to place an array of upwardly extending metal spikes over a section of roadway from approximately 10 to 25 feet wide. Other devices using spikes or the like are disclosed in U.S. Pat. No. 5,330,285 and U.S. Pat. No. 5,820,293. These and similar devices are typically deployed by hand; i.e. they are carried to a site where the target vehicle is expected and placed in the roadway in the hope that the vehicle will drive over the extended spikes.

Further solutions include Pacholok et al, U.S. Pat. No. 5,839,849 which describe a mechanical tire deflating device deployed by ejection forwardly from the front of a pursuing vehicle to a position beneath a second vehicle immediately in front of the law enforcement vehicle. According to the patent, a folded tire deflator is deployed forwardly of the law enforcement vehicle by a spring loaded launcher mounted on the front of the law enforcement vehicle. The deflator carries spikes which penetrate the tires of the target vehicle. Abukhader, U.S. Pat. No. 5,611,408 describes another vehicle disabling device. The patent discloses a folded tire deflating device that is deployed from a launcher mounted on the underside of the front of a law enforcement vehicle. Upon deployment spikes are extended in such a way as to penetrate the tires of a target vehicle. A laser beam is used to aim the tire deflator. Both the Pacholok et al and Abukhader devices pose a threat that the pursuing vehicle will run over the tire deflator which has been deployed from it.

Further related references include: De Sylva, U.S. 2005/0038592, discloses a system for selectively disabling a vehicle. In the illustrative embodiment, the system adapted to prevent high-speed automotive chases. The system includes a first mechanism for locating vehicle to be disabled. A second mechanism launches a disabling projectile toward the vehicle. A third mechanism employs the projectile to disable the vehicle by suffocating an engine of the vehicle or otherwise compromising the fuel/air mixture. In a specific embodiment, and an infrared guidance system guides the projectile toward a muffler of the vehicle, and a muffler-plugging agent incorporated within the projectile plugs a muffler. Holder, U.S. Pat. No. 5,067,237, discloses a battering ram for forcible entry through a door that has a pointed end with barbs to enable the door to be hooked and pulled outward. The barbs will swing between contracted and expanded positions. This spring biases the barbs to the expanded position. The barbs are conical and define a cone with the same taper as the pointed tip when the barbs are collapsed. One end of the battering ram may have a loop for attaching to a line connected to a vehicle. Also, one end of the battering ram may have a battering plate or may have a bar for prying burglar bars outward. Amiand et al., U.S. Pat. No. 5,480,108, discloses an anchoring system using a harpoon secured under a helicopter and a grid platform that includes a shaft, having near its end, fingers oriented and movable radially between a retracted position and an extended position. The shaft includes a device for moving and retaining the fingers in the extended position. The device acts from a state activated in response to the penetration into the grid. It furthermore includes structure for unlocking the fingers and resetting the moving and retaining device. Harpoons including such catching heads, which have the advantage of being light and simple in construction, and capable of being adaptable to all types of helicopters are also contemplated. Fischbach, U.S. Pat. No. 6,246,323, discloses a tagging system for tagging a target vehicle consists of a tracking device, a launching device, a receiving device and a monitor to display the position of the target vehicle. The tracking device includes a tracking chip contained in a pliable carrier, and is stored in and launched from a housing mounted in a pursuit vehicle's grill. The launching device includes a firing pad slidably retained within the housing and spring mounted to the housing rear end. Pad forks in communication with a solenoid retain the firing pad near the housing rear end until two switches in the pursuit vehicle are sequentially activated, whereupon the tracking device emits a tracking signal, the solenoid is activated, releasing pad forks and thereby launching the tracking device towards the target vehicle. The tracking device is in free flight until it impacts ("tags") the surface of the fleeing vehicle, to which it adheres by means of the carrier. The tagged vehicle thus emits a tracking signal which represents the location of the tagged vehicle, which is received by the receiving device and appears as an image on a monitor within the pursuit vehicle. The system can work with a Global Positioning Satellite system or similar navigational or communications satellites. The need to maintain constant visual contact is reduced, and thereby the risk of injury to the public and parties involved in the hot pursuit of a fleeing vehicle. Limingoja, U.S. Pat. No. 6,176,519, discloses a method for forced stopping of a second vehicle by using a first vehicle that includes equipment in the front end of the first vehicle which can be used to engage sheet metal structures, and the front end of the first vehicle is driven into the rear of the second vehicle so that the equipment in the front end of the first vehicle engages the sheet metal structure in the rear of the second vehicle. whereby the second vehicle can be stopped by the first vehicle. The equipment used can include a turning body part and a tip part with gripping device attached to the body part in a detachable way. The gripping device can contain a tip which penetrates the sheet metal structure. The method and the equipment according to the invention can be used to stop a fleeing vehicle without the need to drive beside it or to pass it or to try to force it off the road. Lowrie, U.S. Pat. No. 6,527,475, discloses a system for the selective deployment of a tire deflation device. The system incorporates the use of a mounted housing combined with a compressed gas propulsion source for ejecting a collapsed tire deflation device that is attached to the housing with a tether line. One embodiment of the invention is to have a dual system mounted to the underside of a vehicle behind the rear tires. Each system is pointed in an opposite direction to achieve left or right side deployment. A set of control switches mounted inside the vehicle near the operator can be depressed for either left or right side ejection. Upon ejection the tire deflation device projects laterally away from the vehicle. A remote trigger is disclosed. Ramirez, U.S. Pat. No. 6,623,205, discloses a vehicle disabling device for disabling a fleeing vehicle that has a carriage that is projected from a launch platform using a plurality of elongate extension tubes. The plurality of elongate extension tubes are pneumatically actuated with a tank of compressed air operably connected to the plurality of elongate extension tubes with a pneumatic hose. The carriage includes a pair of carriage wheels and is adapted for rectilinear movement in front of a pursuit vehicle. The carriage also includes a first arm and a second arm connected pivotally to the carriage. A plurality of spikes are disposed along the first and second arms, adapted to puncture the tires of the fleeing vehicle once the fleeing vehicle has run over one of the first and second arms. Brydges et al., U.S. Pat. No. 6,650,283, discloses an invention that is directed to a system for tracking a fleeing vehicle comprising a frangible tracking projectile and a launcher to propel and attach the tracking projectile to the fleeing vehicle. The launcher is a handheld or vehicle mounted pneumatic gun that uses high pressure gas to fire the projectile at the fleeing vehicle. The tracking projectile comprises an outer plastic casing that holds a GPS receiver, a radio transponder and a power source in an adhesive mixture. When the tracking projectile strikes its target, the plastic casing shatters allowing the adhesive substance to attach the GPS receiver, radio transponder and power source to the fleeing vehicle. Heibel, U.S. Pat. No. 6,715,395, discloses a pursuit vehicle that carries a remote targeting device in a suitable position to identify a target area on an inflated tire of the pursued vehicle and a launcher for a projectile suited to puncture an inflated tire of a pursued vehicle, from a position trailing the pursued vehicle. The projectile launcher launches the projectile when suitably triggered. An electrically operated, remote triggering device selectively causes the projectile launcher to launch the projectile at the identified target area, puncturing and thereby disabling the tire of the pursued vehicle.

The related art described above discloses several systems for stopping or identifying a fleeing vehicle including the use of spike strips and other puncture devices. However, the prior art fails to disclose a tethered flying projectile launched from a pursuing vehicle. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

The present invention is a pursuit vehicle used to disable a pursued vehicle by puncturing one of its tires so that the pursued vehicle is disabled but not likely to go out of control. The pursuit vehicle carries a projectile housed within a launcher mounted on its front end. The projectile is able to be directed at high speed from the launcher toward a tire of the pursued vehicle. A tether line is coiled about a tether reel within the chase vehicle is fixed to the projectile. The line is of a flexible but high tensile strength material such as a steel alloy, a titanium alloy, a polymer such as nylon, or of carbon fiber, and may be made of an elastic cord so as to stretch as necessary while still restraining the projectile from free movement. As the projectile moves toward the pursued vehicle the tether reel is motor driven to play out the line so that the line does not present a drag on the projectile and so that the projectile strikes the tire with maximum force. The projectile has folded barbs that extend once the projectile has entered the tire and which keep the projectile from flying out of the tire due to centripetal force. Being penetrated, the tire quickly looses pressure and deflates while the tether line wraps itself around the wheel's axle and brakes which can cause the wheel to stop spinning. Should the projectile miss the target, the tether prevents it from endangering the public and makes it relatively easy to retrieve since the motor driven reel is able to be reversed thereby drawing-in the line. Also, since the projectile is relatively small it does not present a significant danger to the pursuing vehicle should it run over the projectile.

A primary objective inherent in the above described apparatus and method of use is to provide a relatively safe way to deflate a tire of a fleeing vehicle.

A further objective is to provide a means for targeting the fleeing vehicle with a projectile.

A still further objective is to provide a means for launching the projectile at the tire, penetrating the tire and preventing the projectile from pulling out of the tire.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
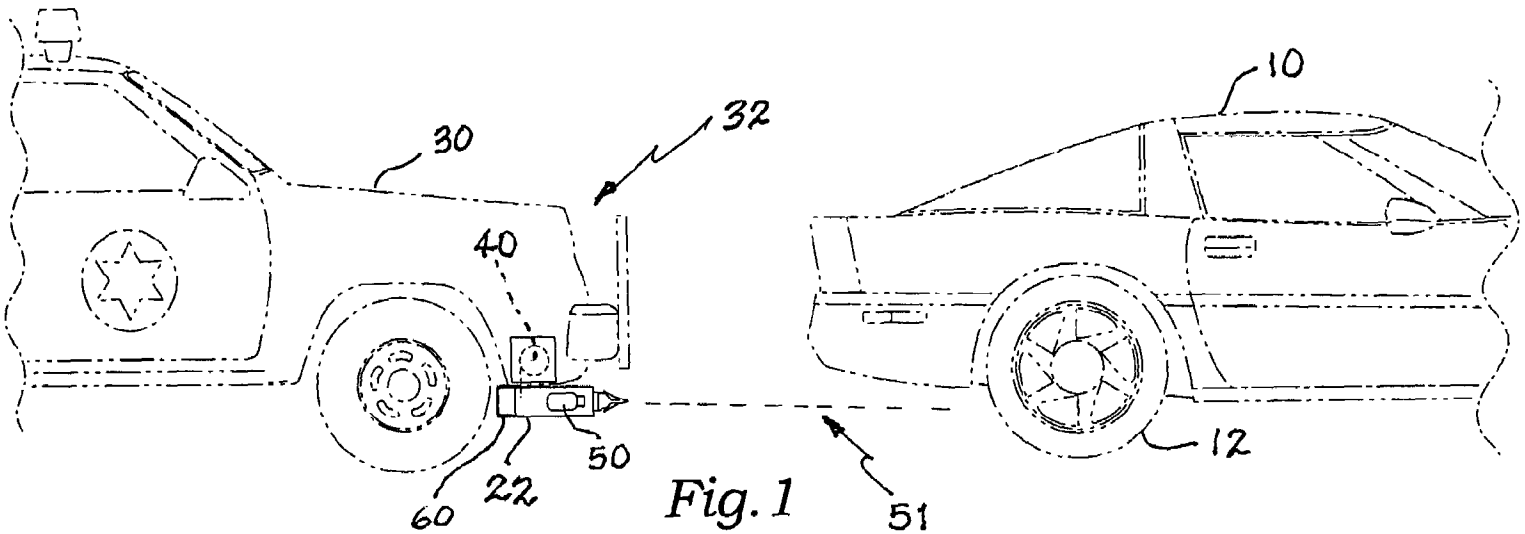
FIG. 1 is an elevational view of the presently described apparatus shown in position for use with a fleeing vehicle.
Figure 2:
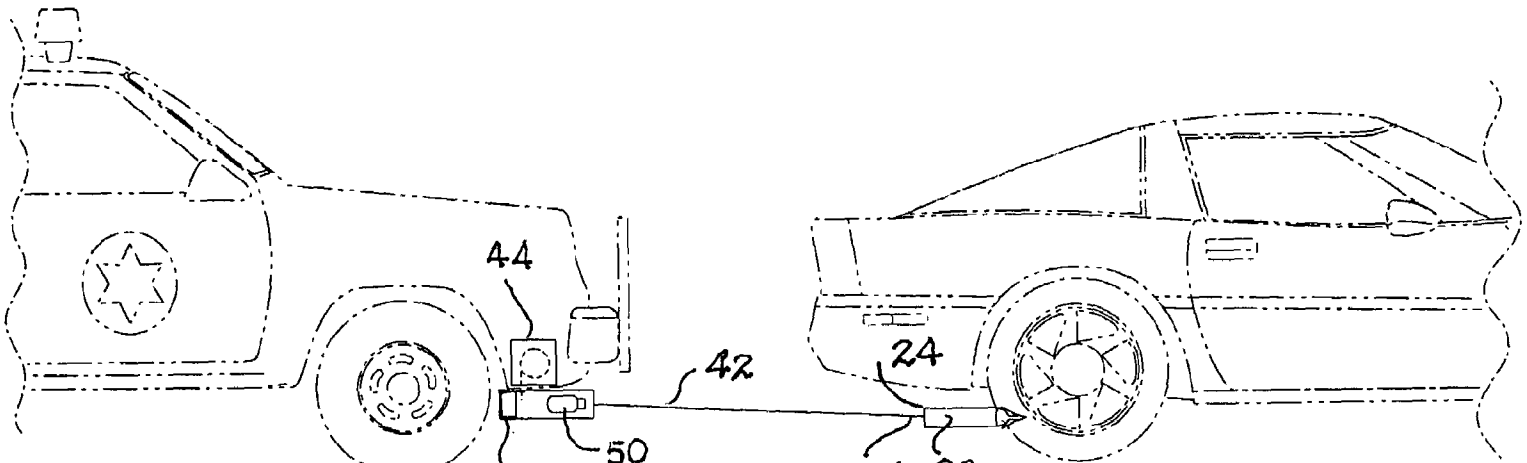
FIG. 2 is a further elevational view thereof showing the manner in which the apparatus is executed.

Described now in detail is an apparatus for disabling a pursued vehicle 10 from a following pursuing vehicle 30 by puncturing the pursued vehicle's tire 12 with a projectile 20. The projectile 20 is housed within a projectile launcher 22, preferably of tubular shape which is mounted on a front end 32 of a chase vehicle 30, such as a police cruiser, as shown in FIG. 1. The projectile 20 initially is fitted within launcher 22 until it is directed at high speed from the launcher 22 toward the tire 12 of the pursued vehicle 10, as shown in FIG. 2. A tether line 42 is stored in a coiled configuration within the pursuing vehicle 30 and may be coiled about a tether reel 40 or merely in a free-play-out coil as is well known. The free end 42' of the line 42 is fixed to the rear end 24 of the projectile 20. The line 42 is preferably constructed of a steel alloy, a titanium alloy, a polymer such as nylon or carbon fiber, i.e., the line 42 is highly flexible and has high tensile strength. As the projectile moves away from the chase vehicle 30, its coiled portion plays out as best shown in FIG. 2 but is always tethered to the chase vehicle 30.

The launcher 22 provides a propulsor 60 positioned and adapted for propelling the projectile 20 from the launcher 22 forward of the chase vehicle 30. The propulsor 60 may be any means for shooting the projectile 20 out of the launcher 22 including a compressed gas canister as is well known in paint ball projection. The propulsor 60 may alternately be a compressed expansion spring which, when a retaining latch is withdrawn by a solenoid for instance, the spring is freed to propel the projectile 20 from the launcher. Finally, an explosive charge may be detonated for rifle-like action in projecting the projectile 20. The propulsor may function in any of the above ways for others well known to those of skill in the projectile arts including guns, cannon and rockets. For example, Fischbach, U.S. Pat. No. 6,246,323 and Abukhader, U.S. Pat. No. 5,611,408 each teaches a means for launching a projectile in a manner similar to the present invention, and are therefore incorporated herein by reference for such teaching.

Figure 3:
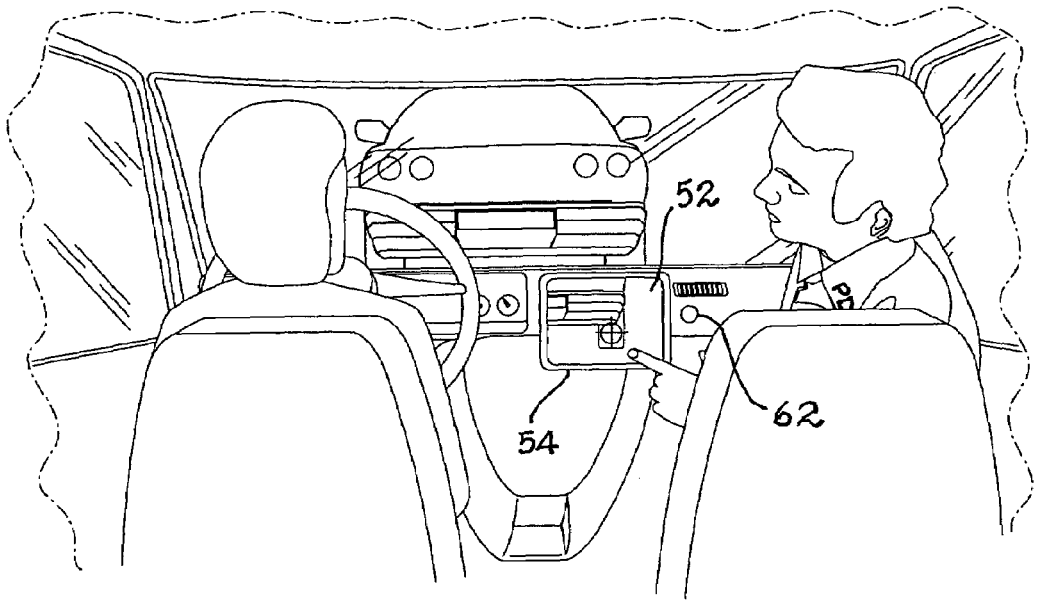
FIG. 3 is an interior view thereof showing the use of a further element of the apparatus.

A video camera 50 is mounted on the launcher 22 so as to sight forward of the chase vehicle 30, see dashed line 51 in FIG. 1, in acquiring a video image 52 as shown in FIG. 3. However, in this disclosure and claims, the usage "video camera" shall also mean equivalents thereof such as a helmet mounted sighting device and controller well known in military applications, a laser sight, a thermal imager, a radar locator and other known sighting devices well known in the art. In the preferred embodiment, a video display 54 displays the image 52 within the chase vehicle 50, i.e., the video image 52 is communicated from the video camera 50 to the video display 54 so that it can be viewed by the occupants of the chase vehicle 30. Therefore, the tire 12 of the pursued vehicle 10 may be easily targeted by the occupants of the chase vehicle. This is accomplished by using a reticle or cross hairs either printed on the lens of the video camera 50, or added into the video image 52 electronically as is well known in the art. The cross hairs appear on the video display 54 as shown in FIG. 3.

Targeting the launcher 22 and projectile 20 merely involves properly positioning the chase vehicle 30 relative to the pursued vehicle 10. When the chase vehicle 30 is too far from the pursued vehicle 10, the horizontal cross hair will be below the image of tire 12 that appears on the video display 54, and when the vehicle 30 is too close, the horizontal cross hair will be above the tire's image. This is corrected using the gas pedal and brake pedal appropriately in the chase car 30 until the horizontal crosshair is positioned as shown in FIG. 3. When the vertical cross hair is positioned to the left or right of the tire image correction is made using the steering wheel in the chase vehicle 30 to further correct alignment.

Clearly, the targeting method used in the present apparatus may use a wave energy transceiving device based on one or more of: video, radar, sonar, radio frequency, ultrasonic sound technique.

When the cross-hairs are on the tire's image, as shown in FIG. 3, the launcher 22 and projectile 20 are in position to direct the projectile 20 into the tire 12, as shown in FIG. 2. To accomplish this, a propulsor enabler 62 within the chase vehicle 30 as shown in FIG. 3, and which is in communication with the propulsor 60, is manually enabled thereby actuating the propulsor 60 and launching the projectile 20. Enabler 62 is preferably a solenoid circuit actuated by the button on the dashboard shown in FIG. 3. Such a solenoid circuit is able to puncture a gas canister, release a spring, or actuate a fuse to detonate a charge, etc. as would be well within the skill of those in the art.

Preferably, a reel motor 44, an electric motor operating from the 12 volt battery of the chase vehicle, is engaged with the tether reel 40 for driving the tether reel 40 to unwind the tether line 42 simultaneously with the flight of the projectile 20. Since the acceleration and velocity of the projectile is determinant by experimentation, a motor circuit for driving the tether reel 30 at an associated rotational speed to allow the tether line 42 to be delivered to the projectile 20. Both the propulsor 60 as well as the reel motor 44 are actuated simultaneously in this case by the propulsor enabler 62.

Figure 4:
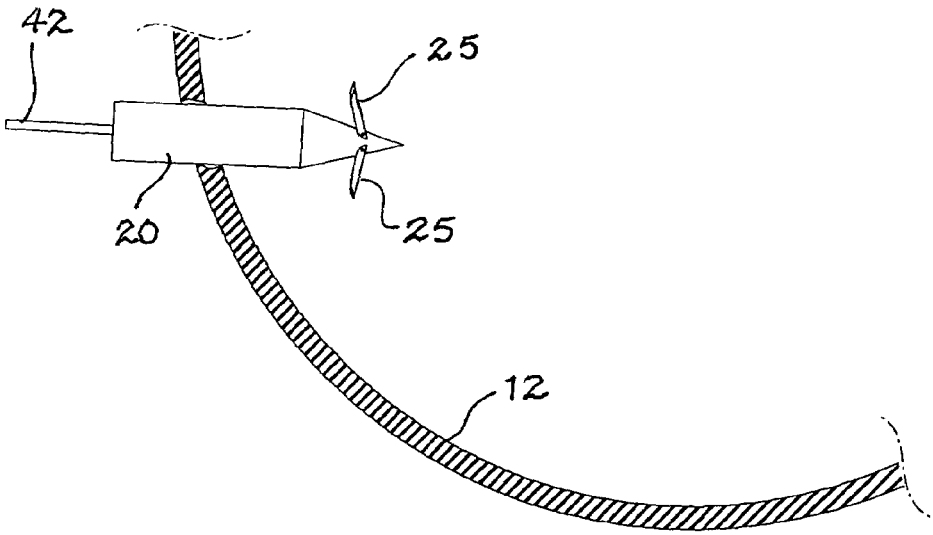
FIG. 4 is a partial vertical sectional view of a tire being punctured by a projectile of the apparatus.

Of necessity, the projectile 20 has plural pivotal barbs 25 positioned thereon, the barbs 25 adapted for swinging outwardly from the projectile 20 upon deceleration thereof because the barbs are hinged forward on the projectile 20 with the barbs 25 extending rearwardly on the projectile 20. As the projectile 20 penetrates the tire 12 it quickly decelerates and the barbs 25 fly outwardly as shown in FIG. 4. The barbs 25 are incapable of withdrawing to their initial positions because as the projectile attempts to pull out of the tire casing, the barbs 25 prevent such pull out and prevent the barbs 25 from folding to their original positions. Therefore, the projectile is secured within the tire 12.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus comprising: a chase vehicle supporting at a front end thereof, and at an elevation approximately at the center of tires of the chase vehicle, a projectile housed within a tubular projectile launcher; a tether having a length of tether line coiled thereon, one end of the tether line fixed to the projectile; the projectile launcher providing a propulsor positioned and adapted for propelling the projectile from the launcher forward of the chase vehicle; a video camera positioned adjacent to the tubular projectile launcher for sighting forward of the chase vehicle at an elevation of the projectile; a video image display positioned for viewing from within the chase vehicle, the video image display adapted for receiving an image from the video camera for targeting the projectile on a tire of a pursued vehicle, and a propulsor enabler within the chase vehicle, the propulsor enabler in communication with the propulsor for launching the projectile.

2. The apparatus of claim 1 wherein the propulsor is one of: a compressed gas canister, a compressed expansion spring and an explosive charge.

3. The apparatus of claim 1 further comprising a reel motor engaged with the tether reel and with the propulsor enabler for driving the tether reel to unwind the tether line simultaneously with activating the propulsor.

4. The apparatus of claim 1 wherein the tether line is comprised of at least one of: a steel alloy, a titanium alloy, a polymer, and a carbon fiber.

5. The apparatus of claim 1 wherein the projectile has plural pivotal barbs positioned thereon, the barbs adapted for swinging outwardly from the projectile upon deceleration thereof, the barbs incapable of withdrawing so as to secure the projectile within a tire.

* * * * *